US009350128B1

(12) United States Patent
Chen et al.

(10) Patent No.: US 9,350,128 B1
(45) Date of Patent: May 24, 2016

(54) ADAPTER

(71) Applicant: Cheng Uei Precision Industry Co., Ltd., New Taipei (TW)

(72) Inventors: Wen-Chih Chen, New Taipei (TW); Chuan-Hung Lin, New Taipei (TW); Kuo-Chih Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/678,911

(22) Filed: Apr. 3, 2015

(51) Int. Cl.
*H01R 27/02* (2006.01)
*H01R 13/66* (2006.01)

(52) U.S. Cl.
CPC ..... *H01R 27/02* (2013.01); *H01R 13/665* (2013.01)

(58) Field of Classification Search
CPC ... H01R 13/648; H01R 31/06; H01R 13/6593
USPC ..... 439/638, 654, 607.01, 607.55
See application file for complete search history.

(56) References Cited

U.S. PATENT DOCUMENTS

| | | | | |
|---|---|---|---|---|
| 5,041,024 | A * | 8/1991 | Liu | H01R 31/06 439/654 |
| 5,639,262 | A * | 6/1997 | Lim | H01R 31/06 439/638 |
| 7,338,327 | B2 * | 3/2008 | Sticker | H01R 13/506 439/638 |
| 8,308,494 | B1 * | 11/2012 | Zhao | H01R 13/60 439/131 |
| 2013/0217274 | A1 * | 8/2013 | Bar-Niv | H01R 27/02 439/676 |

* cited by examiner

*Primary Examiner* — Briggitte R Hammond
(74) *Attorney, Agent, or Firm* — Cheng-Ju Chiang

(57) ABSTRACT

An adapter includes a first electrical connector structure having a first terminal, a second electrical connector structure connected with the first electrical connector structure and having a second terminal electrically connected with the first terminal, a first metallic sleeve with substantial U-shape, and a second metallic sleeve with substantial U-shape. The first metallic sleeve and the second metallic sleeve are covered to a junction of the first electrical connector structure and the second electrical connector structure from two opposite sides of the first electrical connector structure and the second electrical connector structure and then engaged with each other to fix the first electrical connector structure and the second electrical connector structure together.

4 Claims, 4 Drawing Sheets

ADAPTER

BACKGROUND OF THE INVENTION

1. Field of the Invention

The present invention relates to an adapter, and more particularly to an adapter for avoiding the adapter scratched.

2. The Related Art

A traditional adapter includes a first connector and a second connector, the first connector and the second connector has difference specification for converting electrical connection mode. The periphery of the first connector and the second connector has a first metallic shell and a second metallic shell sheathed, respectively. The part of first metallic shell and the second metallic shell is sheathed by a metallic sleeve and is soldered with the metallic sleeve.

A general method for the production of the metallic sleeve is punching a metal piece to form a single rectangle ring-shaped sleeve. When the first connector and the second connector are slid into the metallic sleeve, a friction is formed therebetween to cause scratch. The scratch makes the inspection of the adapter failure.

SUMMARY OF THE INVENTION

Accordingly, an object of the present invention is to provide an adapter. The adapter includes a first electrical connector structure having a first terminal, a second electrical connector structure connected with the first electrical connector structure and having a second terminal electrically connected with the first terminal, a first metallic sleeve with substantial U-shape, and a second metallic sleeve with substantial U-shape. The first metallic sleeve and the second metallic sleeve are covered to a junction of the first electrical connector structure and the second electrical connector structure from two opposite sides of the first electrical connector structure and the second electrical connector structure and then engaged with each other to fix the first electrical connector structure and the second electrical connector structure together.

As described above, the first metallic sleeve and the second metallic sleeve are covered to the junction of the first electrical connector structure and the second electrical connector structure from two opposite sides of the first electrical connector structure and the second electrical connector structure and then engaged with each other to fix the first electrical connector structure and the second electrical connector structure together, therefore, the adapter is prevented from scratch.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
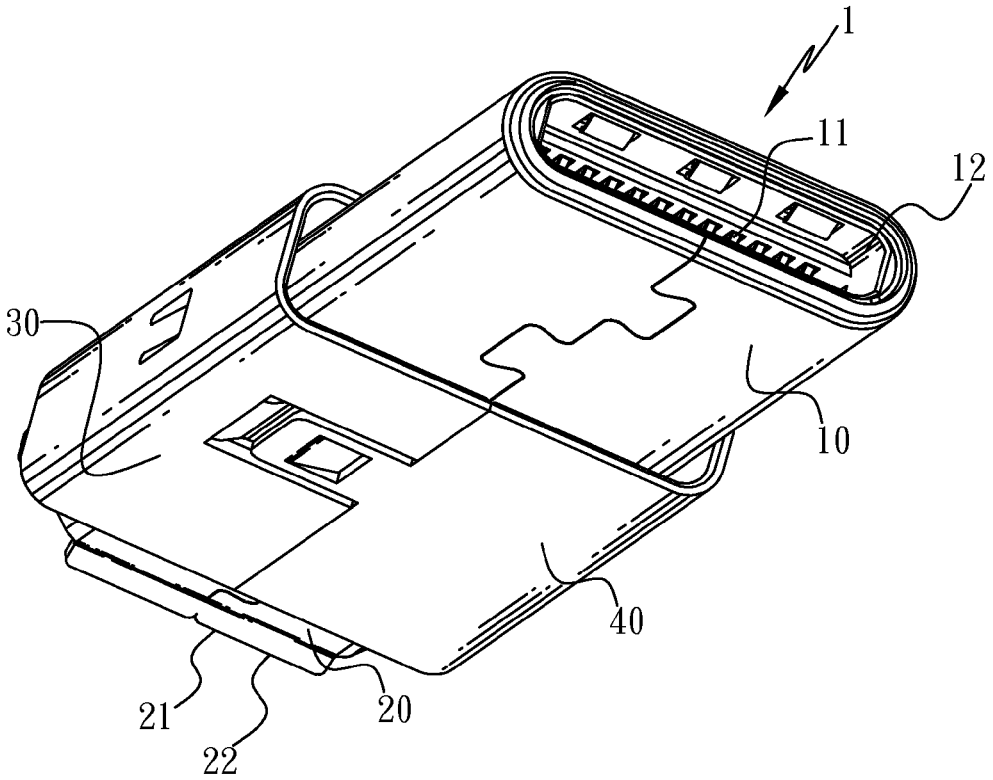
FIG. 1 is an assembled, perspective view of an adapter in accordance with an embodiment of the present invention.

Referring to FIG. 1, an embodiment of the present invention is shown as an adapter 1 which includes a first electrical connector structure 10, a second electrical connector structure 20, a first metallic sleeve 30 and a second metallic sleeve 40.

The first electrical connector structure 10 has a first terminal 11. A periphery of the first electrical connector structure 10 is surrounded by a first metallic shell 12.

The second electrical connector structure 20 is connected to the first electrical connector structure 10 and has a second terminal 21 electrically connected to the first terminal 11. A periphery of the second electrical connector structure 20 is surrounded by a second metallic shell 22.

The first metallic shell 12 and the second metallic shell 22 can be made of single metal steel respectively.

Figure 2:
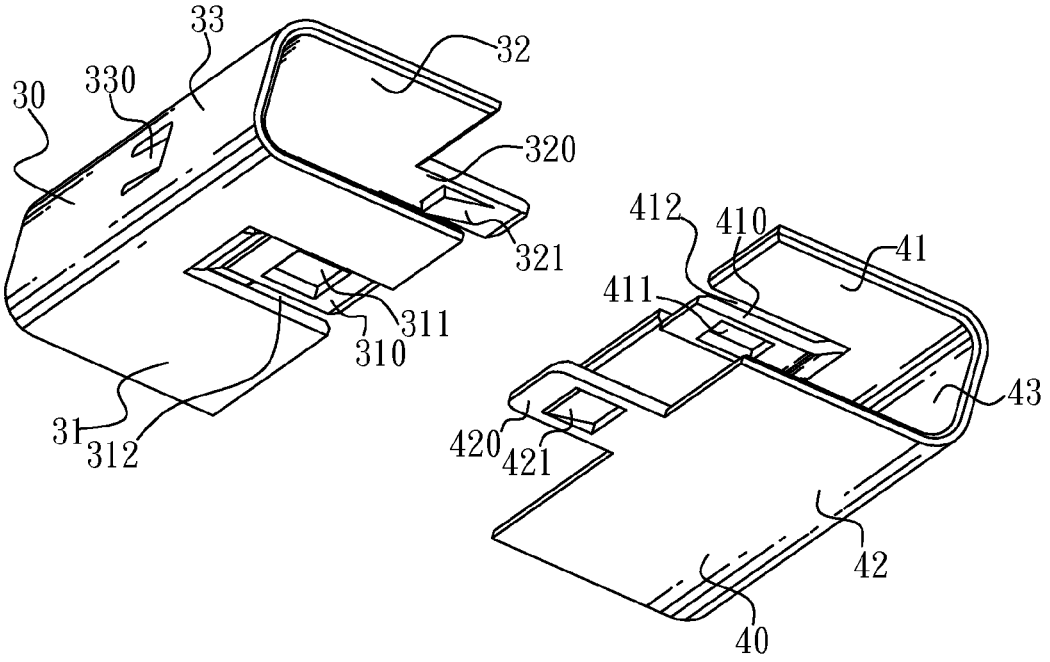
FIG. 2 is an exploded, perspective view of first and second metallic sleeves of the adapter shown in FIG. 1.

Referring to FIG. 2, the first metallic sleeve 30 includes a first side plate 31, a second side plate 32 facing to the first side plate 31 and a third side plate 33 connecting corresponding ends of the first side plate 31 and the second side plate 32. The first metallic sleeve 30 is shown a U-shape. The first side plate 31 is punched inwards to form a first cantilever arm 310 with a first opening 311 defined therein. A first gap 312 penetrating a free end of the first side plate 31 is correspondingly formed in the first side plate 31. A free end of the second side plate 32 extends opposite to the third side plate 33 to form a second cantilever arm 320 at a portion thereof. A first barb 321 is formed at an inside of the second cantilever arm 320. The third side plate 33 is punched inwards to form an elastic piece 330.

The second metallic sleeve 40 includes a fourth side plate 41, a fifth side plate 42 facing to the fourth side plate 42 and a sixth side plate 43 connecting corresponding ends of the fourth side plate 41 and the fifth side plate 42. The second metallic sleeve 40 is shown U-shape. The fourth side plate 41 is punched inwards to form a third cantilever arm 410 with a second opening 411 defined therein. A second gap 412 penetrating a free end of the fourth side plate 41 is correspondingly formed in the fourth side plate 41. A free end of the fifth side plate 42 extends opposite to the sixth side plate 43 to form a fourth cantilever arm 420 at a portion thereof. A second barb 421 is formed at an inside of the fourth cantilever arm 420.

Figure 3:
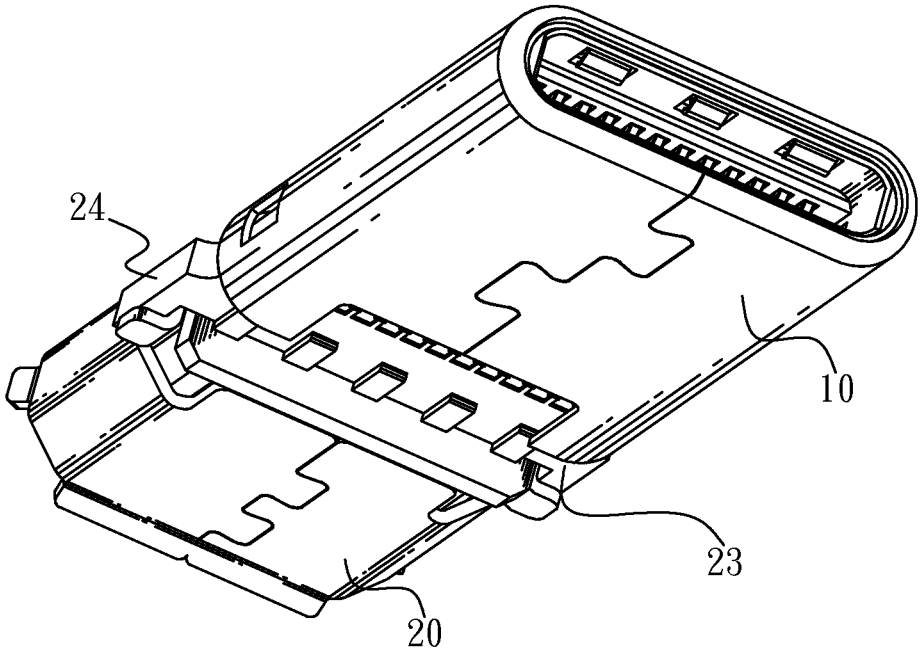
FIG. 3 is a perspective view of the first and second electrical connector structure of the adapter shown in FIG. 1.

Referring to FIG. 3, a groove 23 is formed in a junction of the first electrical connector structure 10 and second electrical connector structure 20. A circuit board 24 is disposed in the groove 23. When the first metallic sleeve 30 and the second metallic sleeve 40 are engaged together, the first cantilever arm 310 and the third cantilever arm 410 is disposed in the groove 23, the elastic piece 330 is stuck on a side edge of the circuit board 24 to provide a frictional force between the third side plate 33 and the circuit board 24.

Figure 4:
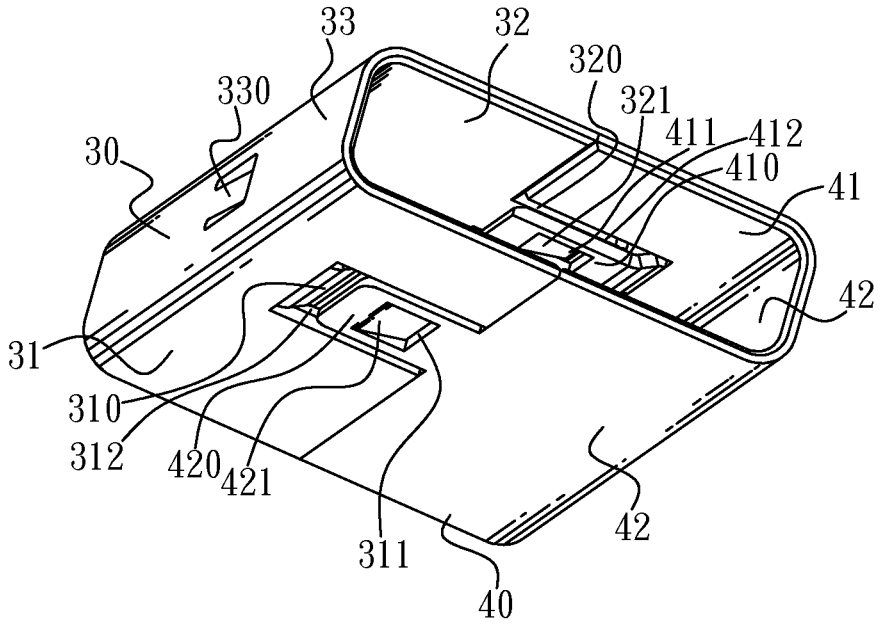
FIG. 4 is a perspective view of the first and second metallic sleeves of the adapter shown in FIG. 1.

Referring to FIG. 4, the assembly of the first metallic sleeve 30 and the second metallic sleeve 40 surrounds the junction of the first electrical connector structure 10 and the second electrical connector structure 20. Specifically, the first metallic sleeve 30 and the second metallic sleeve 40 are covered to the junction of the first electrical connector structure 10 and the second electrical connector structure 20 from two opposite sides of the assembly and then engaged with each other. The second cantilever arm 320 is attached to an outside of the third cantilever arm 410 with the first barb 321 fastened in the second opening 411. The fourth cantilever arm 420 is attached to an outside of the first cantilever arm 310 with the second barb 421 fastened in first opening 311. The first metallic sleeve 30 and the second metallic sleeve 40 are further more firmly fixed to the first metallic shell 12 and the second metallic shell 22 by soldering.

In this embodiment, the first electrical connector structure 10 is a Type-C USB connector, the second electrical connector structure 20 is a Micro-USB connector. In another embodiment of the first electrical connector structure 10 and the second electrical connector structure 20 can be another specification of connectors.

As described above, the first metallic sleeve 30 and the second metallic sleeve 40 are covered to the junction of the first electrical connector structure 10 and the second electrical connector structure 20 from two opposite sides of the first electrical connector structure 10 and the second electrical connector structure 20 and then engaged with each other to fix the first electrical connector structure 10 and the second electrical connector structure 20 together, therefore, the adapter 1 is prevented from scratch.

What is claimed is:

1. An adapter, comprising:

a first electrical connector structure having a first terminal;

a second electrical connector structure connected with the first electrical connector structure, the second electrical connector structure having a second terminal electrically connected with the first terminal;

a first metallic sleeve with substantial U-shape; and a second metallic sleeve with substantial U-shape, the first metallic sleeve and the second metallic sleeve being covered to a junction of the first electrical connector structure and the second electrical connector structure from two opposite sides of the first electrical connector structure and the second electrical connector structure and then engaged with each other to fix the first electrical connector structure and the second electrical connector structure together;

wherein the first metallic sleeve includes a first side plate, a second side plate facing to the first side plate and a third side plate connecting corresponding ends of the first side plate and the second side plate, the first side plate is punched inwards to form a first cantilever arm with a first opening defined therein, a first gap penetrating a free end of the first side plate is correspondingly formed in the first side plate, a free end of the second side plate extends opposite to the third side plate to form a second cantilever arm at a portion thereof, a first barb is formed at an inside of the second cantilever arm, the second metallic sleeve includes a fourth side plate, a fifth side plate facing to the fourth side plate and a sixth side plate connecting corresponding ends of the fourth side plate and the fifth side plate, the fourth side plate is punched inwards to form a third cantilever arm with a second opening defined therein, a second gap penetrating a free end of the fourth side plate is correspondingly formed in the fourth side plate, a free end of the fifth side plate extends opposite to the sixth side plate to form a fourth cantilever arm at a portion thereof, a second barb is formed at an inside of the fourth cantilever arm, the second cantilever arm is attached to an outside of the third cantilever arm with the first barb fastened in the second opening, the fourth cantilever arm is attached to an outside of the first cantilever arm with the second barb fastened in the first opening.

2. The adapter as claimed in claim 1, wherein a junction of the first electrical connector structure and the second electrical connector structure forms a groove with a circuit board disposed therein, the first cantilever arm and the third cantilever arm is disposed in the groove.

3. The adapter as claimed in claim 2, wherein the third side plate is punched inwards to form an elastic piece against a side edge of the circuit board.

4. The adapter as claimed in claim 1, wherein the first electrical connector structure is a Type-C universal serial bus (USB) connector, the second electrical connector structure is a Micro-USB connector.

* * * * *